US009442441B2

(12) United States Patent
Hiramatsu

(10) Patent No.: US 9,442,441 B2
(45) Date of Patent: Sep. 13, 2016

(54) FIXING DEVICE

(71) Applicant: Brother Kogyo Kabushiki Kaisha, Nagoya-shi, Aichi-ken (JP)

(72) Inventor: Seiji Hiramatsu, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/864,978

(22) Filed: Sep. 25, 2015

(65) Prior Publication Data

US 2016/0091845 A1 Mar. 31, 2016

(30) Foreign Application Priority Data

Sep. 29, 2014 (JP) ..... 2014-198794
Jul. 24, 2015 (JP) ..... 2015-146420

(51) Int. Cl.
*G03G 15/20* (2006.01)

(52) U.S. Cl.
CPC .. *G03G 15/2053* (2013.01); *G03G 2215/0141* (2013.01); *G03G 2215/2035* (2013.01)

(58) Field of Classification Search
CPC ..... G03G 2215/2035; G03G 15/2064; G03G 21/0094; G03G 15/2053; G03G 15/2032; G03G 15/553; G03G 15/2017; G03G 2215/2009; G03G 15/2057; G03G 15/161; G03G 15/2025
See application file for complete search history.

(56) References Cited

U.S. PATENT DOCUMENTS

| | | | | |
|---|---|---|---|---|
| 7,027,763 | B2 | 4/2006 | Kato et al. | |
| 8,737,895 | B2 | 5/2014 | Suzuki et al. | |
| 2004/0151522 | A1 | 8/2004 | Kato et al. | |
| 2010/0322667 | A1* | 12/2010 | Kitagawa | G03G 15/2035 399/122 |
| 2012/0275830 | A1 | 11/2012 | Suzuki et al. | |
| 2013/0136512 | A1 | 5/2013 | Suzuki et al. | |

FOREIGN PATENT DOCUMENTS

| | | | |
|---|---|---|---|
| JP | H03-24577 | A | 2/1991 |
| JP | H04-81787 | A | 3/1992 |
| JP | H05-165351 | A | 7/1993 |
| JP | 2003-076178 | A | 3/2003 |
| JP | 2003-270977 | A | 9/2003 |
| JP | 2004-184814 | A | 7/2004 |
| JP | 2008-076589 | A | 4/2008 |
| JP | 2012-233969 | A | 11/2012 |
| JP | 2013-114058 | A | 6/2013 |

* cited by examiner

*Primary Examiner* — Roy Y Yi
(74) *Attorney, Agent, or Firm* — Banner & Witcoff, Ltd.

(57) ABSTRACT

A fixing device includes a guide member including a guide portion, which is disposed downstream from a nip in a rotational direction of an endless belt and is in contact with the endless belt, and a gap forming portion, which is disposed between the nip and the guide portion in the rotational direction of the endless belt and which forms a gap from the endless belt. The gap forming portion includes an inclined surface that extends from the guide portion upstream in the rotational direction and has a predetermined area, on which a lubricant is provided. A maximum inclination angle between the predetermined area and a plane that is defined to contact a downstream end, in the rotational direction, of the contact portion of the nip member and the guide portion is less than 90 degrees.

20 Claims, 10 Drawing Sheets

FIXING DEVICE

CROSS-REFERENCE TO RELATED APPLICATION

This application claims priority from Japanese Patent Applications No. 2014-198794 filed on Sep. 29, 2014 and No. 2015-146420 filed on Jul. 24, 2015, the entire subject matter of which is incorporated herein by reference.

TECHNICAL FIELD

The present disclosure relates to a fixing device for thermally fixing a developer image on a recording sheet.

BACKGROUND ART

A fixing device for thermally fixing a developer image on a recording sheet such as a paper sheet is disclosed, and the fixing device includes an endless belt, a nip member that comes into sliding contact with the inner circumferential surface of the endless belt, a pressure roller that forms a nip between the endless belt and the pressure roller, and a guide member that is disposed downstream from the nip in the rotational direction of the endless belt and guides the endless belt getting out of the nip between the nip member and the pressure roller.

In the fixing device, the guide member includes a downstream guide that guides the endless belt and a depressed portion that is formed between the nip and the downstream guide, and a gap is formed between the endless belt and the guide member by the depressed portion. Accordingly, it is possible to suppress heat of the endless belt from being lost to the guide member or to reduce sliding resistance between the endless belt and the guide member.

SUMMARY

However, since a lubricant is provided between the endless belt and the nip member or the like, the lubricant attached to the inner circumferential surface of the endless belt may be scraped out with the depressed portion of the guide member and may flow into the depressed portion. Among the lubricant flowing into the depressed portion, the lubricant which is present close to the endless belt is taken out by the endless belt and is used for lubrication again, but there is a possibility that the lubricant which is present apart from the endless belt stays in the depressed portion and is not used for lubrication. When a part of the lubricant is not used for lubrication, for example, an amount of lubricant between the endless belt and the nip member or the like may not be sufficient and sliding resistance of the endless belt may increase.

In consideration of the above-mentioned circumstances, the present disclosure is to provide a fixing device capable of suppressing an increment of sliding resistance of an endless belt.

A fixing device of the present disclosure includes: an endless belt, which is rotatable; a nip member, which includes a contact portion capable of being in contact with an inner circumferential surface of the endless belt; a backup member, wherein a nip between is formed between the endless belt and the backup member with interposing the endless belt between the nip member and the backup member; and a guide member. The guide member includes: a guide portion, which is disposed downstream from the nip in a rotational direction of the endless belt and is configured to be in contact with the inner circumferential surface of the endless belt, and a gap forming portion, which is disposed between the nip and the guide portion in the rotational direction of the endless belt and which is separated from the endless belt to form a gap from the endless belt. The gap forming portion includes an inclined surface that extends from the guide portion toward upstream in the rotational direction and has a predetermined area, on which a lubricant is provided. A maximum inclination angle between the predetermined area and a plane that is defined to contact a downstream end, in the rotational direction, of the contact portion of the nip member and the guide portion is less than 90 degrees.

A fixing device of this disclosure includes: an endless belt, which is rotatable; a nip member, which includes a contact portion capable of being in contact with an inner circumferential surface of the endless belt; a backup member, wherein a nip between is formed between the endless belt and the backup member with interposing the endless belt between the nip member and the backup member; and a guide member. The guide member includes: a guide portion, which is disposed downstream from the nip in a rotational direction of the endless belt and is configured to be in contact with the inner circumferential surface of the endless belt, and a gap forming portion, which is disposed between the nip and the guide portion in the rotational direction of the endless belt and which is separated from the endless belt to form a gap from the endless belt. The gap forming portion includes an inclined surface that extends from the guide portion toward upstream in the rotational direction. A maximum inclination angle between an area that is located within 2 millimeters from a downstream end, in the rotational direction, of the gap forming portion and a plane that is defined to contact a downstream end, in the rotational direction, of the contact portion of the nip member and the guide portion is less than 90 degrees.

According to the configuration related to the inclined surface, since the lubricant collected between the endless belt and the inclined surface can be moved to the inner circumferential surface of the endless belt along the inclined surface by the rotation of the endless belt, it is possible to improve capability of supplying the lubricant to the inner circumferential surface of the endless belt. Accordingly, since a sufficient amount of lubricant can be interposed between the endless belt and the nip member, it is possible to suppress an increment of sliding resistance of the endless belt.

According to the disclosure, it is possible to suppress an increment of sliding resistance of the endless belt.

BRIEF DESCRIPTION OF THE DRAWINGS

The foregoing and additional features and characteristics of this disclosure will become more apparent from the following detailed descriptions considered with the reference to the accompanying drawings, wherein.

DETAILED DESCRIPTION

Figure 1:
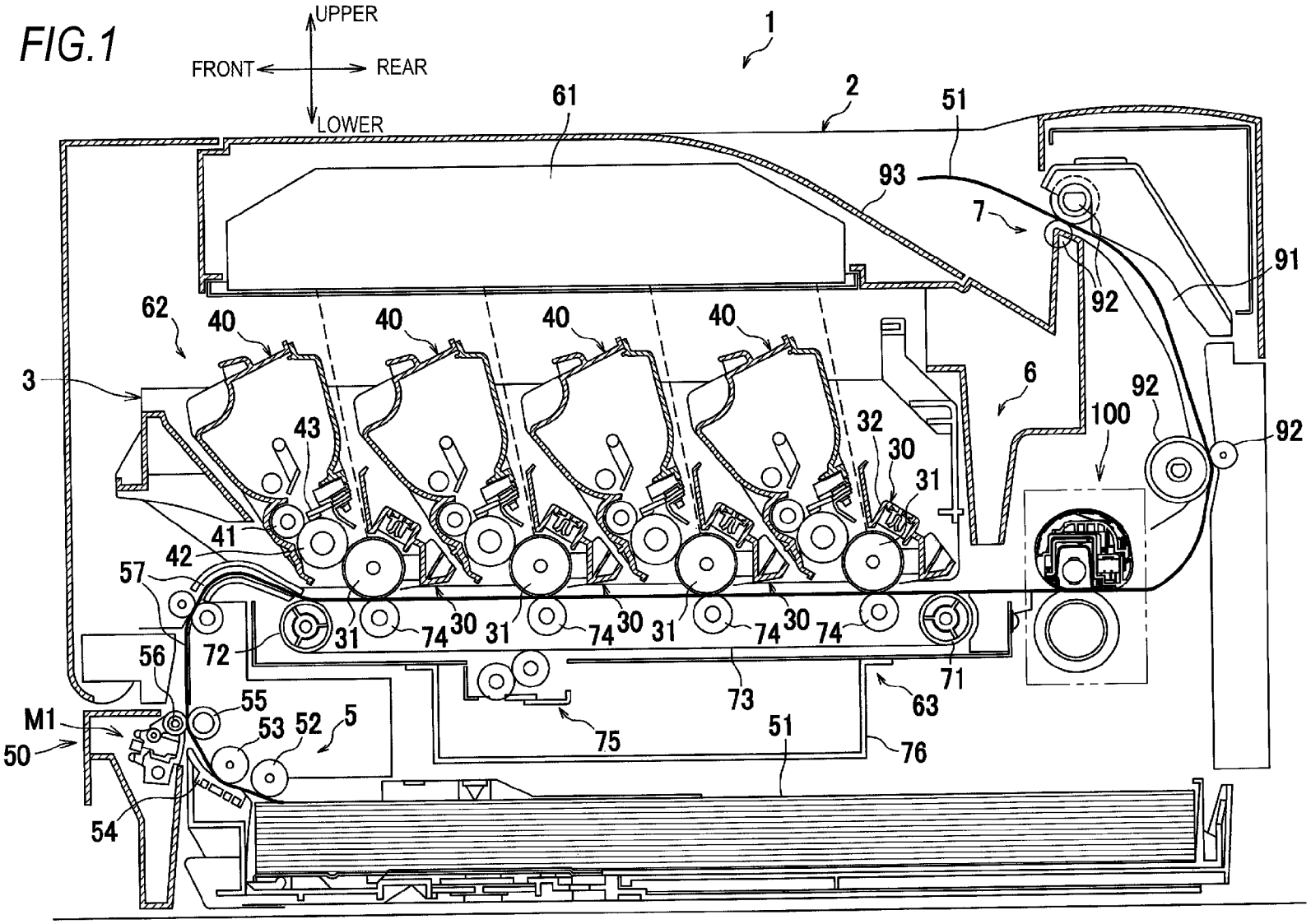
FIG. 1 is a cross-sectional view illustrating a color laser printer including a fixing device according to an embodiment of the disclosure.

Hereinafter, embodiments of the disclosure will be described in detail properly with reference to the accompanying drawings. In the following description, unless particularly mentioned, an up-down direction in FIG. 1 denotes an up-down direction, a left side in FIG. 1 denotes a front side, a right side denotes a rear side, a back side in the drawing denotes a left side, a front side in the drawing denotes a right side. Here, the right and left sides are defined on a basis of a view of a person when the person stands on the front side of a color laser printer 1.

Configuration of Color Laser Printer

As illustrated in FIG. 1, the color laser printer 1 includes a sheet feeding unit 5 that feeds a sheet 51 (a recording sheet), an image forming unit 6 that forms an image on the fed sheet 51, and a sheet discharging unit 7 that discharges the sheet 51 having an image formed thereon, in an apparatus body 2 thereof. The printer 1 outputs (discharges) the sheet 51, on which the image is formed, by a throughput of 50 ppm (pages per minutes). The throughput of the printer 1 may be a range from 30 to 80 ppm or a range from 40 to 60 ppm.

The sheet feeding unit 5 includes: a sheet feeding tray 50 that is attached to and detached from the apparatus body 2 from the front side at the lower side of the apparatus body 2; and a sheet feeding mechanism M1 that picks up a sheet 51 from the sheet feeding tray 50, inverts the sheet 51 to the rear side, and conveys the sheet 51.

The sheet feeding mechanism M1 includes a pickup roller 52, a separation roller 53, and a separation pad 54 which are installed in the vicinity of the front end of the sheet feeding tray 50. The sheets 51 in the sheet feeding tray 50 are separated one by one and are conveyed upward by these elements. The sheet 51 conveyed upward passes between a paper dust removing roller 55 and a pinch roller 56, passes through a conveyance path 57, is inverted to the rear side, and is fed onto a conveyance belt 73 to be described later. While the sheet 51 is being passing between the paper dust removing roller 55 and the pinch roller 56, paper dust attached to the sheet 51 is removed from the sheet 51 by the paper dust removing roller 55.

The image forming unit 6 includes a scanner unit 61, a process unit 62, a transfer unit 63, and a fixing device 100.

The scanner unit 61 is formed at the upper part of the apparatus body 2 and includes a laser beam emitting unit, a polygon mirror, and plural lenses and mirrors, although not illustrated. In the scanner unit 61, the right-left direction is scanned at a high speed with laser beams emitted from the laser beam emitting unit to correspond to colors of cyan, magenta, yellow, and black using the polygon mirror. The laser beams transmitted or reflected by the lenses and mirrors are applied to photosensitive drums 31 (see the dotted lines).

The process unit 62 is disposed below the scanner unit 61 and above the sheet feeding unit 5 and includes a photosensitive member unit 3 that is movable in the front-rear direction with respect to the apparatus body 2. The photosensitive member unit 3 includes drum subunits 30 and developer cartridges 40 attached to the drum subunits 30.

Each drum subunit 30 includes a known photosensitive drum 31 and a scorotron type charger 32.

The developer cartridge 40 has toner (developer) contained therein and includes a known supply roller 41, a developing roller 42, and a thickness regulating blade 43.

The process unit 62 functions as follows. The toner in the developer cartridge 40 is supplied to the developing roller 42 by the supply roller 41 and the toner is frictionally charged to the positive polarity between the supply roller 41 and the developing roller 42 at this time. The toner supplied to the developing roller 42 is rubbed by the thickness regulating blade 43 with the rotation of the developing roller 42 and is held as a thin layer with a constant thickness on the surface of the developing roller 42.

On the other hand, in each drum subunit 30, the scorotron type charger 32 evenly charges the photosensitive drum 31 to the positive polarity by corona discharge. The charged photosensitive drum 31 is irradiated with the laser beam from the scanner unit 61 and an electrostatic latent image corresponding to an image to be formed on the sheet 51 is formed on the photosensitive drum 31.

When the photosensitive drum 31 rotates, the toner held on the developing roller 42 is supplied to the electrostatic image on the photosensitive drum 31, that is, a part, which has been exposed to a laser beam and which has a decreased potential, on the surface of the photosensitive drum 31 which has been uniformly charged to the positive polarity. Accordingly, the electrostatic latent image on the photosensitive drum 31 is visualized and a toner image due to reversal development is held on the surface of the photosensitive drum 31 to correspond to the color toner.

The transfer unit 63 includes a driving roller 71, a follower roller 72, a conveyance belt 73, a transfer roller 74, and a cleaning unit 75.

The driving roller 71 and the follower roller 72 are disposed to be separated in the front-rear direction in parallel with each other, and the conveyance belt 73 which is an endless belt is wound and suspended on these rollers. The outer surface of the conveyance belt 73 is in contact with the photosensitive drum 31. The transfer roller 74 nipping the conveyance belt 73 between the photosensitive drum 31 and the transfer roller 74, is disposed inside the conveyance belt 73. A transfer bias is applied to the transfer roller 74 from a high-voltage board (not illustrated). When forming an image, the sheet 51 conveyed by the conveyance belt 73 is nipped by the photosensitive drum 31 and the transfer roller 74 and the toner image on the photosensitive drum 31 is transferred to the sheet 51.

The cleaning unit 75 is disposed below the conveyance belt 73 and is configured to remove toner attached to the conveyance belt 73 and to drop the removed toner into a toner reservoir 76.

The fixing device 100 is disposed in the back of the transfer unit 63 and thermally fixes the toner image transferred onto the sheet 51 to the sheet 51. The fixing device 100 will be described later in detail.

In the sheet discharging unit 7, a discharge-side conveyance path 91 of the sheet 51 is formed to extend upward from an exit of the fixing device 100 and to be inverted toward the front side. Plural conveyance rollers 92 conveying the sheet 51 are disposed in the discharge-side conveyance path 91. A sheet discharging tray 93 on which the printed sheet 51 is piled is formed on the top surface of the apparatus body 2, and the sheet 51 discharged from the discharge-side conveyance path 91 by the conveyance rollers 92 is piled on the sheet discharging tray 93.

Detailed Configuration of Fuser Unit

Figure 2:
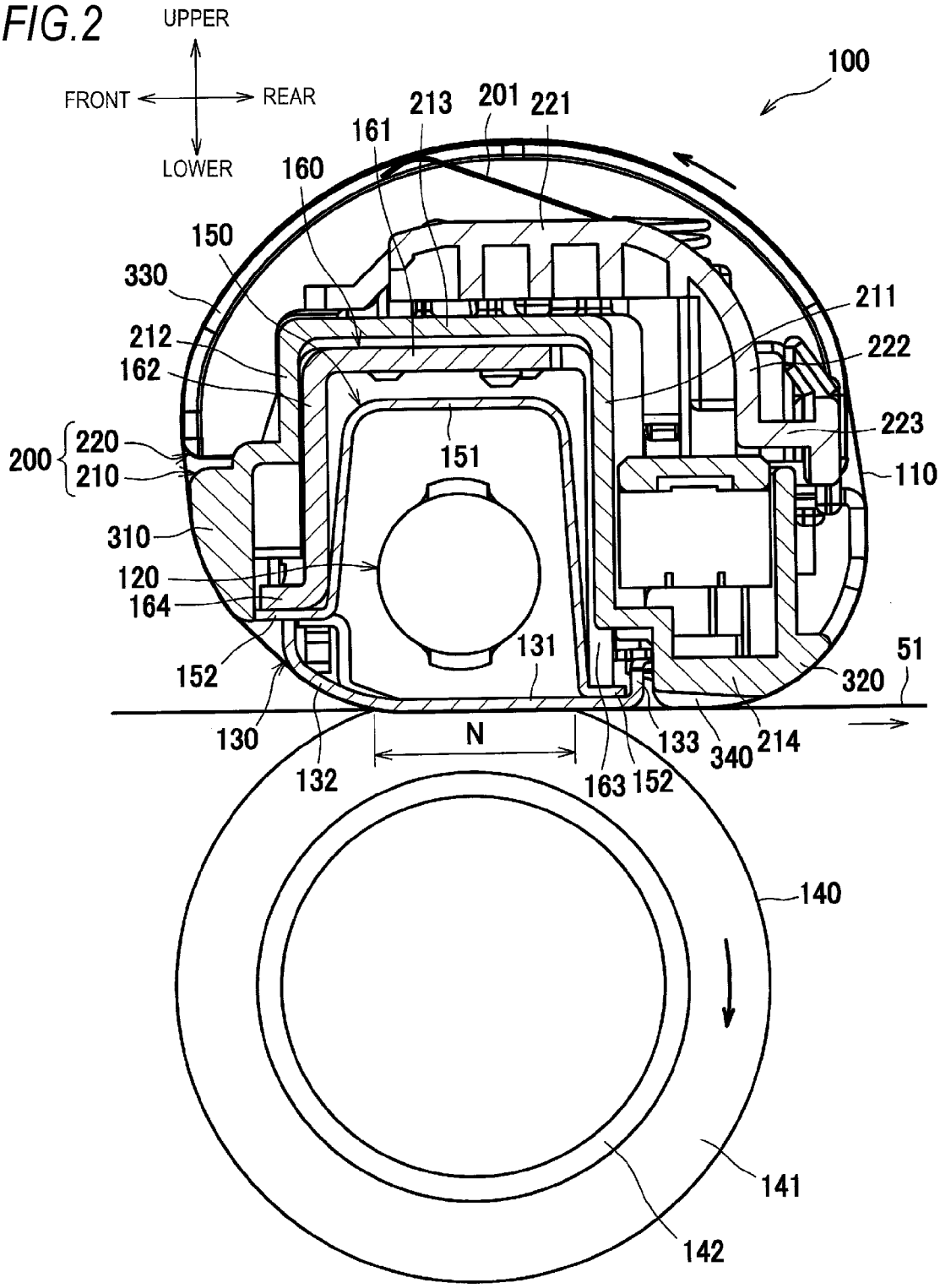
FIG. 2 is a cross-sectional view illustrating the fixing device.

As illustrated in FIG. 2, the fixing device 100 mainly includes a fixing belt 110 as an example of the endless belt, a halogen lamp 120 (heater), a nip plate 130 as an example of the nip member, a pressure roller 140 as an example of the backup member, a reflective plate 150, a stay 160, a cover member 200 made of a resin.

As rotating of the pressure roller, the sheet 51 is conveyed through the fixing device 100 at a velocity of 300 mm per second. The velocity of the sheet 51 conveyed through the fixing device 100 may be a range from 200 to 800 mm per second, a range from 200 to 600 mm per second, or a range from 250 to 350 mm per second.

The fixing belt 110 is an endless (cylindrical) belt having heat resistance and flexibility and the rotation thereof is guided by guides (an upstream guide 310, a downstream guide 320, and end guides 330 and 340) formed in the cover member 200. Specifically, in this embodiment, the fixing belt 110 is formed as a metal belt including a metal base member and a resin with which the outer circumference of the substrate is coated. Additionally, this fixing belt 110 is formed as a resign belt, in which a main component of the base member is polyimide.

The fixing belt 110 may have a rubber layer on the metal surface and may further include a nonmetal protective layer which is formed by coating the surface of the rubber layer with fluorine or the like.

The fixing belt 110 is urged to the outside in the radial direction with a weak elastic urging force by a wire spring 201 disposed in the cover member 200, and thus the fixing belt 110 is supplied with a tension from the wiring spring 201 and is movable in the radial direction.

A member for applying a tension to the fixing belt 110 is not limited to the wire spring 201, but may be, for example, a leaf spring. The wire spring 201 is not necessary, and the fixing belt 110 may be configured to be movable in the radial direction by excluding the wire spring 201.

In order to enhance slidability between the fixing belt 110 and the nip plate 130 or the like, grease 190 (see FIG. 5) as an example of the lubricant is disposed on the inner circumferential surface of the fixing belt 110. For example, fluorine-based grease having heat resistance can be used as the grease 190. The grease 190 has a penetration of 250. The penetration of the grease 190 may be a range from 100 to 500, a range from 150 to 400, or a range from 180 to 370. The consistency in this embodiment indicates a worked penetration (25 degrees Celsius), which is measured by a measuring method defined in JIS K2220 7.

The halogen lamp 120 is a member, which heats the toner on the sheet 51 by emitting radiant heat to heat the nip plate 130 and the fixing belt 110 (nip N), and is disposed inside the fixing belt 110 with a predetermined gap from the inner surfaces of the fixing belt 110 and the nip plate 130.

The nip plate 130 is a plate-shaped member that is disposed inside the fixing belt 110 and is supplied with radiant heat from the halogen lamp 120, and the bottom surface (plate-shaped portion 131) thereof is disposed to come in sliding contact with the inner circumferential surface of the fixing belt 110. In this embodiment, the nip plate 130 is formed of a metal and is formed, for example, by bending an aluminum plate or the like having high heat conductivity than that of the stay 160 formed of steel to be described later. In case where the nip plate 130 is formed of aluminum, it is possible to enhance the heat conductivity of the nip plate 130.

Figure 3:
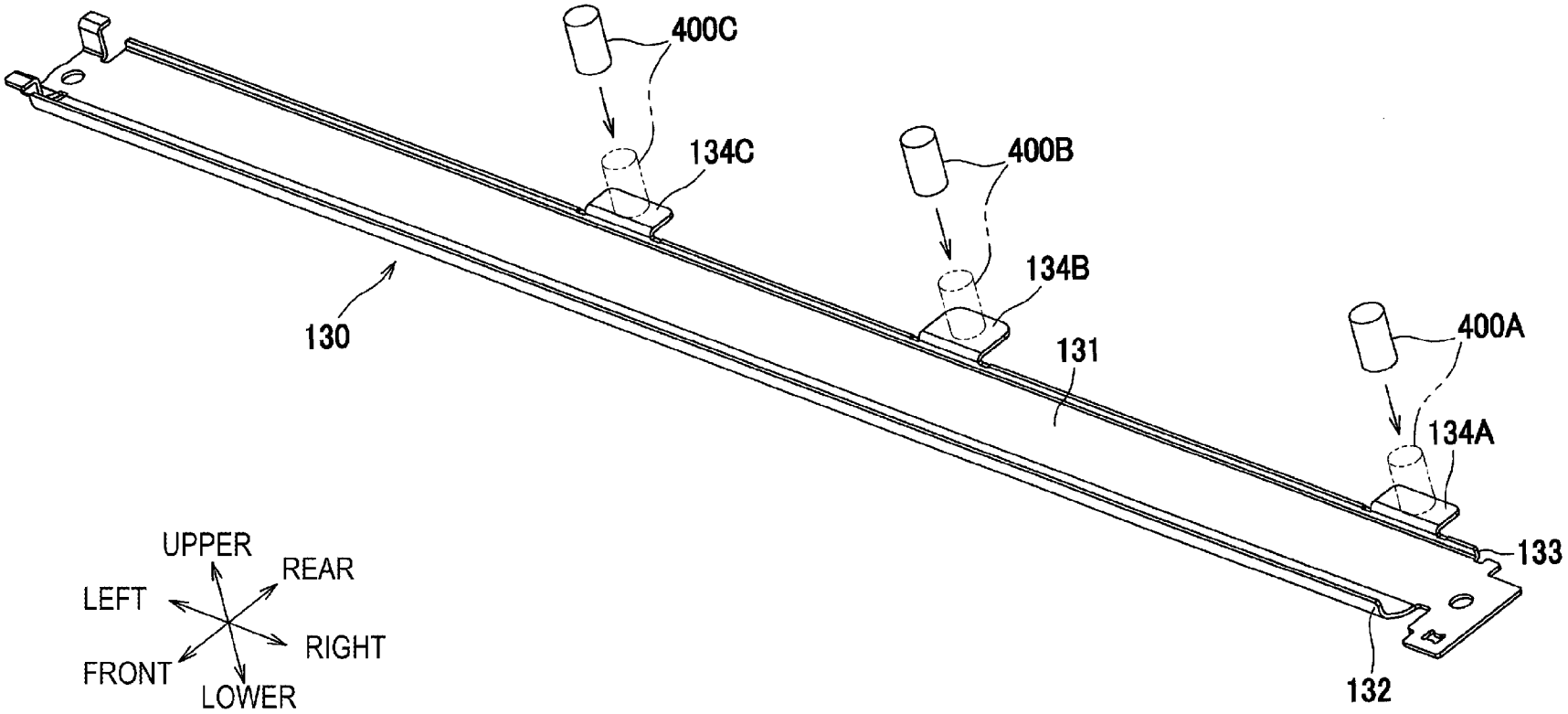
FIG. 3 is a perspective view illustrating a nip plate.

As illustrated in FIGS. 2 and 3, the nip plate 130 includes a plate-shaped portion 131 as an example of the sliding contact portion, a front-side bent portion 132, a rear-side bent portion 133, and three detection target portions 134A, 134B, and 134C.

The plate-shaped portion 131 is formed in a longitudinal plate shape which is perpendicular to the up-down direction and which is long in the right-left direction. The inner surface (top surface) of the plate-shaped portion 131 may be painted in black or may be provided with a heat absorbing member. According to this configuration, it is possible to efficiently absorb the radiant heat from the halogen lamp 120.

The front-side bent portion 132 is formed to be bent upwards in a substantially arc shape from the front end of the plate-shaped portion 131. Specifically, the front-side bent portion 132 is bent toward a flange 164 of the stay 160 and the top end surface thereof is supported by a flange 152 of the reflective plate 150 and the flange 164 of the stay 160.

The rear-side bent portion 133 is formed to extend upward from the rear end of the plate-shaped portion 131.

The three detection target portions 134A, 134B, and 134C are portions, from which a temperature is detected by thermistors 400A and 400B or a thermostat 400C, and are formed to extend backward from a part of the top end of the rear-side bent portion 133.

As illustrated in FIG. 2, the pressure roller 140 is a member that forms a nip N between the fixing belt 110 and the pressure roller 140 by nipping the fixing belt 110 between the nip plate 130 and the pressure roller 140, and is disposed below the nip plate 130. In this embodiment, in order to form the nip N, one of the nip plate 130 and the pressure roller 140 is elastically supported to the other. By rotating in a state in which the fixing belt 110 is interposed between the nip plate 130 and the pressure roller 140, the pressure roller 140 rotates together with the fixing belt 110 to convey the sheet 51 to the rear side.

The pressure roller 140 includes a cylindrical roller body 141 and a shaft 142 which is inserted into the roller body 141 and which is rotatable together with the roller body 141. An axis direction of the pressure roller 140 is along with a longitudinal direction of the nip plate 130. The roller body 141 is configured to be elastically deformable. The pressure roller 140 is configured to be rotationally driven with the supply of a driving force from a motor (not illustrated) installed in the apparatus body 2, and rotates the fixing belt 110 by a frictional force with the fixing belt 110 (or the sheet 51) to follow the rotational driving. The sheet 51 onto which the toner image has been transferred is conveyed to a place (the nip N) between the pressure roller 140 and the heated fixing belt 110, so that the toner image (toner) is thermally fixed.

The reflective plate 150 is a member that reflects radiant heat from the halogen lamp 120 toward the nip plate 130 and is disposed with a predetermined gap from the halogen lamp 120 so as to surround the halogen lamp 120 inside the fixing belt 110.

The reflective plate 150 is formed, for example, by curving an aluminum plate or the like having high reflectance of infrared light and far-infrared light in a U shape in a cross-sectional view. More specifically, the reflective plate 150 includes a reflective portion 151 having a U shape and flanges 152 extending outward in the front-rear direction from both edges (edges on the nip plate 130 side) in the front-rear direction of the reflective portion 151.

The flanges 152 are nipped between the stay 160 and the nip plate 130.

The stay 160 is a member receiving a load from the pressure roller 140 by supporting the nip plate 130 with the reflective plate 150 interposed therebetween, and is disposed to surround the halogen lamp 120 or the reflective plate 150 inside the fixing belt 110. Here, the load refers to a reaction force of a force with which the nip plate 130 elastically supports the pressure roller 140 in the configuration in which the nip plate 130 elastically supports the pressure roller 140.

Specifically, the stay 160 is formed in a U shape in a cross-sectional view by a top wall 161, a front wall 162 extending downward from the front end of the top wall 161, and a rear wall 163 extending downward from the rear end of the top wall 161. The flange 164 extending to the front side is formed at the bottom end of the front wall 162.

The stay 160 is formed, for example, by bending a steel sheet having relatively high rigidity.

The cover member 200 mainly includes, as an example of the guide member, a first cover member 210 formed of a resin and a second cover member 220 formed of a resin.

The first cover member 210 is formed to be a U shape in a cross-sectional view and to extend longitudinally in the right-left direction, and is disposed to cover the stay 160 on the opposite side of the halogen lamp 120 with respect to the stay 160. In other words, the first cover member 210 is disposed on the opposite side of the nip plate 130 with respect to the stay 160.

The first cover member 210 mainly includes a rear wall 211, a front wall 212, a top wall 213 extending to connect the top ends of the rear wall 211 and the front wall 212, and an extension wall 214 extending backward from the bottom end of the rear wall 211. An upstream guide 310 is formed at the bottom end of the front wall 212, and a downstream guide 320 as an example of the guide portion is formed at the rear end of the extension wall 214.

Figure 4:
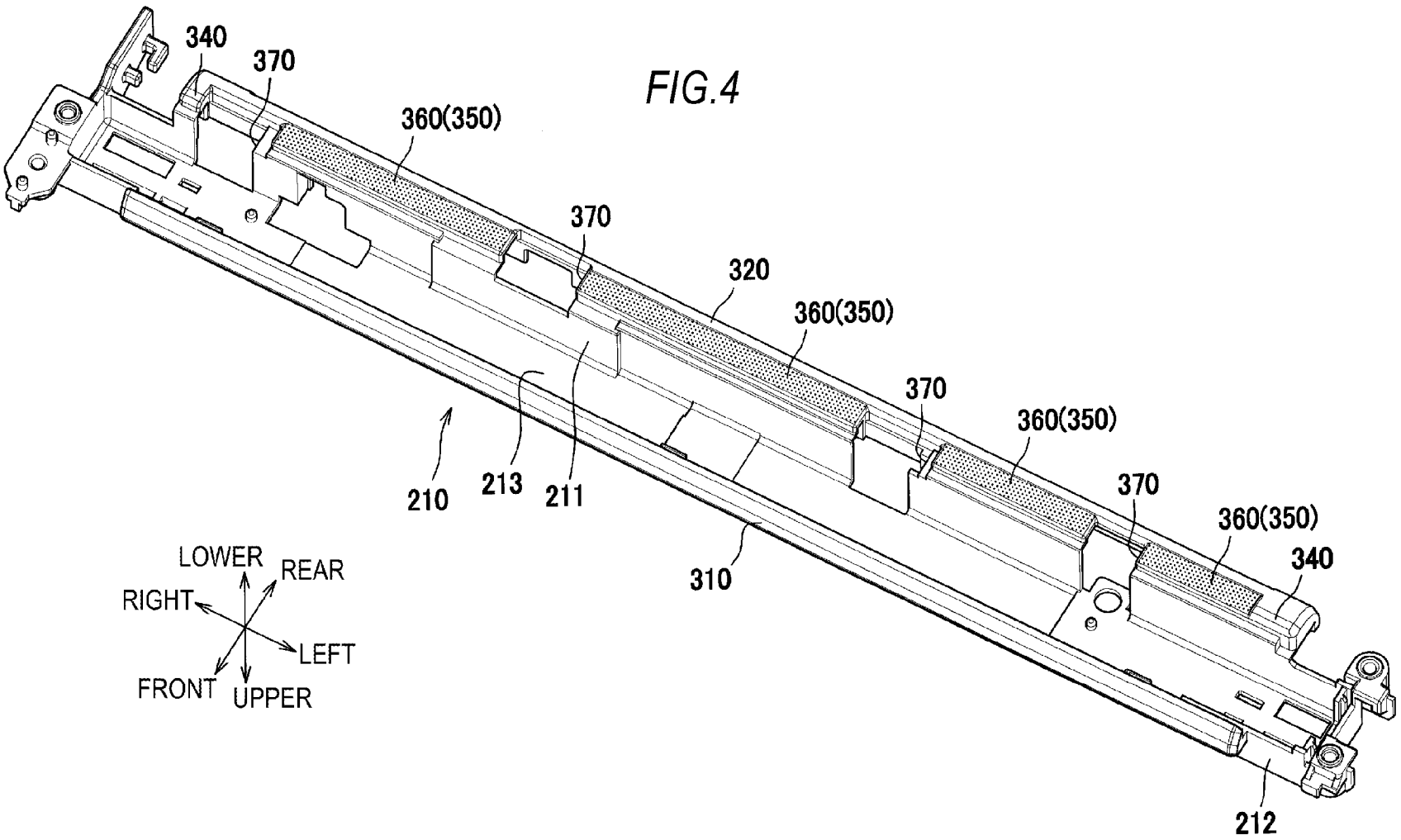
FIG. 4 is a perspective view of a first cover member as viewed from the lower side.

As illustrated in FIG. 2 and FIG. 4 which is a bottom view of the first cover member 210, the upstream guide 310 is disposed upstream from the nip N in the rotational direction of the fixing belt 110 and is formed in a longitudinal shape extending in the right-left direction. The upstream guide 310 comes into sliding contact with the inner circumferential surface of the fixing belt 110 and guides the fixing belt 110 toward the nip N (a place between the nip plate 130 and the pressure roller 140).

The downstream guide 320 is disposed downstream from the nip N in the rotational direction of the fixing belt 110 and is formed in a long shape continuously extending from one end of the fixing belt 110 to the other end in the width direction of the fixing belt 110. The downstream guide 320 comes into sliding contact with the inner circumferential surface of the fixing belt 110 and guides the fixing belt 110 getting out of the nip N. Detailed configurations of the periphery of the downstream guide 320 will be described later.

As illustrated in FIG. 2, the second cover member 220 is formed to extend longitudinally in the right-left direction and is disposed on the upper side of the first cover member 210 (the opposite side of the stay 160) to cover a part of the first cover member 210. The second cover member 220 includes a top wall 221, a rear wall 222 extending downward from the rear end of the top wall 221, and an extension wall 223 extending backward from the bottom end of the rear wall 222. A pair of end guides 330 (of which only one is illustrated) that comes into sliding contact with the inner circumferential surfaces of both ends of the fixing belts 110 to guide the fixing belt 110 to the upstream guide 310 is formed at both ends in the right-left direction of the top wall 221.

Detailed Configuration of Periphery of Downstream Guide

Figure 5:
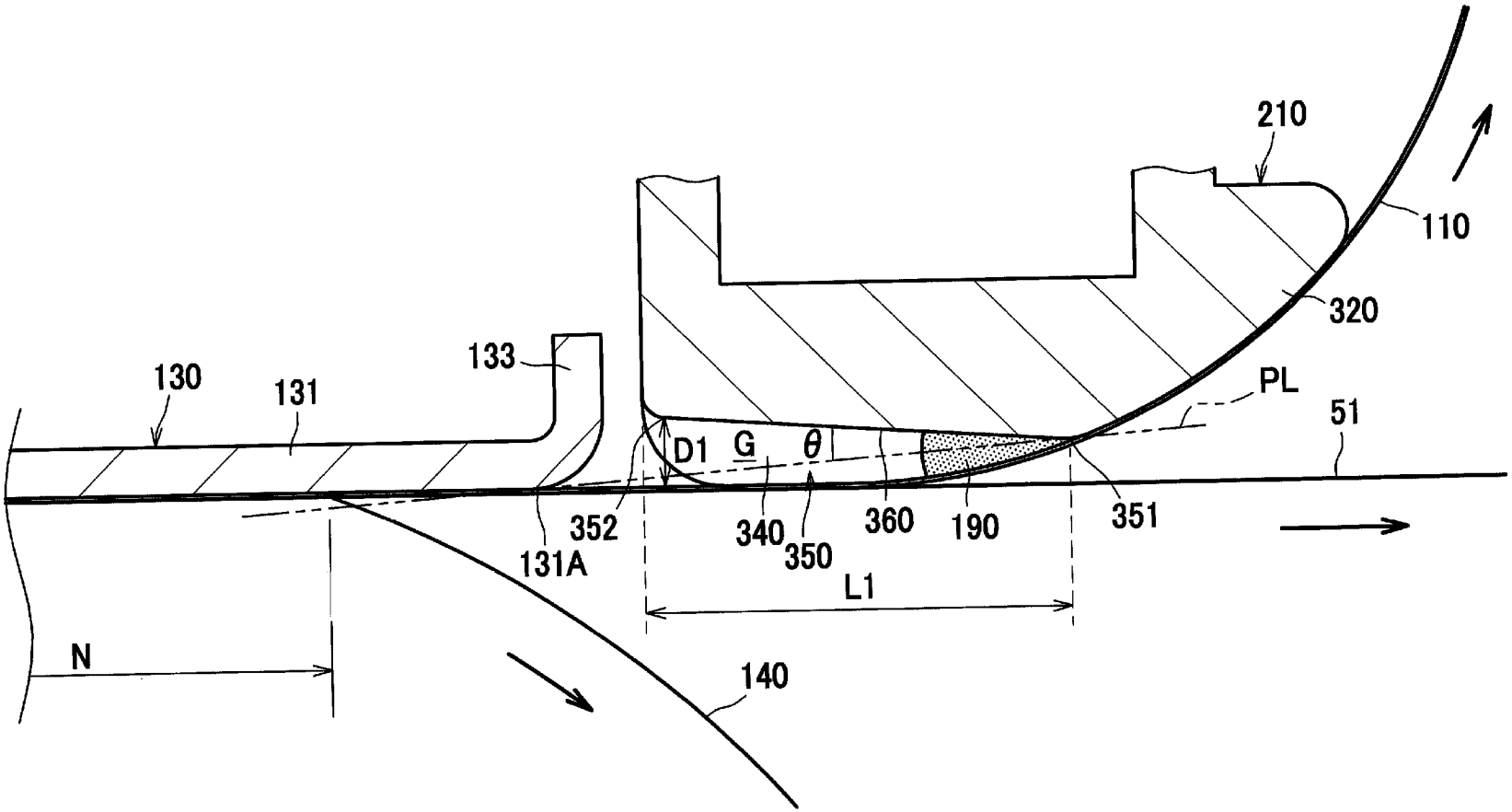
FIG. 5 is an enlarged cross-sectional view of the periphery of a downstream guide.

As illustrated in FIGS. 4 and 5, the first cover member 210 includes a downstream guide 320 and a pair of end guides 340 and a gap forming portion 350, which are disposed between the nip N and the downstream guide 320 in the rotational direction of the fixing belt 110. The downstream guide 30 is a resign frame having heat tolerance, such as a liquid polymer, and is harder than the fixing belt 110.

The pair of end guides 340 is disposed at positions corresponding to both ends of the fixing belt 110 in the width direction of the fixing belt 110, and comes in sliding contact with the inner circumferential surfaces of both ends of the fixing belt 110 to guide the fixing belt 110 toward the downstream guide 320. The end guides 340 are formed in a cross-sectional shape to be smoothly connected to the downstream guide 320.

The gap forming portion 350 is formed as a depressed portion having a shape concave inward in the radial direction of the fixing belt 110 between a pair of end guides 340 in the width direction of the fixing belt 110. As illustrated in FIG. 5, the gap forming portion 350 is separated from the fixing belt, between the nip N and the downstream guide 320 in the rotational direction of the fixing belt 110. Since the contact area between the fixing belt 110 and the first cover member 210 is small due to this gap G, it is possible to suppress heat of the fixing belt 110 from being lost to the first cover member 21 or to reduce sliding resistance between the fixing belt 110 and the first cover member 210.

The gap forming portion 350 can be configured, for example, such that the length L1 in the rotational direction of the fixing belt 110 is equal to or larger than 0.7 mm or is equal to or less than 5.2 mm.

In this embodiment, the bottom surface of the gap forming portion 350 is formed as an inclined surface inclined over the entire area from a downstream end 351 to an upstream end 352 in the rotational direction of the fixing belt 110. Specifically, the inclined surface 360 is a surface which extends to approach the fixing belt 110 from the upstream end 352 of the gap forming portion 350 to the downstream end 351 and which is smoothly connected to the downstream guide 320. Additionally, the inclined surface 360 extends from the nip plate 130 to the pressing roller 140, as forwarding from the upstream end 350 of the gap forming portion 350 to the downstream end portion 351.

The inclined surface 360 is formed such that an angle (maximum inclination angle) θ of the most inclined part with respect to a plane PL that is defined to be in contact with the downstream end 131A of the plate-shaped portion 131 and the downstream guide 320 in the rotational direction of the fixing belt 110 is less than 90 degrees (is an acute angle). Accordingly, in any part of the inclined surface 360 in the rotational direction of the fixing belt 110, the inclination angle with respect to the plane PL is less than 90 degrees. As a result, the inclined surface 360 is formed, for example, as a surface not having a part perpendicular to the plane PL.

Herein, "the inclination angle of (a part of) the inclined surface 360 with respect to the plane PL" indicates an angle, which is formed in a direction from the pressing roller 140 to the nip plate 130, among angles formed by the part of the inclined surface 360 and the plane PL. That is, "the inclination angle of (a part of) the inclined surface 360 with respect to the plane PL" indicates a degree of opening of (a part of) the inclined surface 360, in the up-down direction (direction from the pressing roller 140 to the nip plate 130) with respect to the plane PL.

The maximum inclination angle θ is preferably equal to or less than 45 degrees, is more preferably equal to or less than 30 degrees, and is still more preferably equal to or less than 15 degrees. For example, the inclined surface 360 in this embodiment has a planar shape, and the inclination angle θ thereof with respect to the plane PL is about 8 degrees.

The maximum depth (the maximum depth in the depth from the guide surface of the end guide 340 for guiding the fixing belt 110 to the bottom surface of the gap forming portion 350) D1 of the gap forming portion 350 may be equal to or larger than 0.7 mm. For example, the maximum depth D1 of the gap forming portion 350 in this embodiment is 0.7 mm.

As illustrated by hatching in FIG. 4, the inclined surface 360 (the gap forming portion 350) is intermittently formed in the right-left direction. In other words, plural inclined surfaces 360 and plural cutout portions 370 formed to divide the inclined surfaces 360 are alternately arranged in the right-left direction in the first cover member 210. When the cover member 200 and the nip plate 130 are attached, the detection target portions 134A, 134B, and 134C (see FIG. 3) are disposed in three cutout portions 370 from the right side.

According to the above-mentioned embodiment, as illustrated in FIG. 5, even when the grease 190 is collected between the fixing belt 110 and the inclined surface 360, the grease 190 can be moved to the inner circumferential surface of the fixing belt 110 along the inclined surface 360 with the rotation of the fixing belt 110, and specifically the grease 190 can be moved between the fixing belt 110 and the downstream guide 32. That is, according to this embodiment, capability of supplying the grease 190 to the inner circumferential surface of the fixing belt 110 can be enhanced by the inclined surface 360. Accordingly, since the sufficient grease 190 can be interposed between the fixing belt 110 and the nip plate 130 or the like, it is possible to suppress an increment of sliding resistance of the fixing belt 110.

The disclosure is not limited to the above-mentioned embodiment, but may be modified in various forms as will be described below. In the following description, members having substantially the same structures as in the above-mentioned embodiment will be referenced by the same reference numerals and description thereof will not be repeated.

Figure 6:
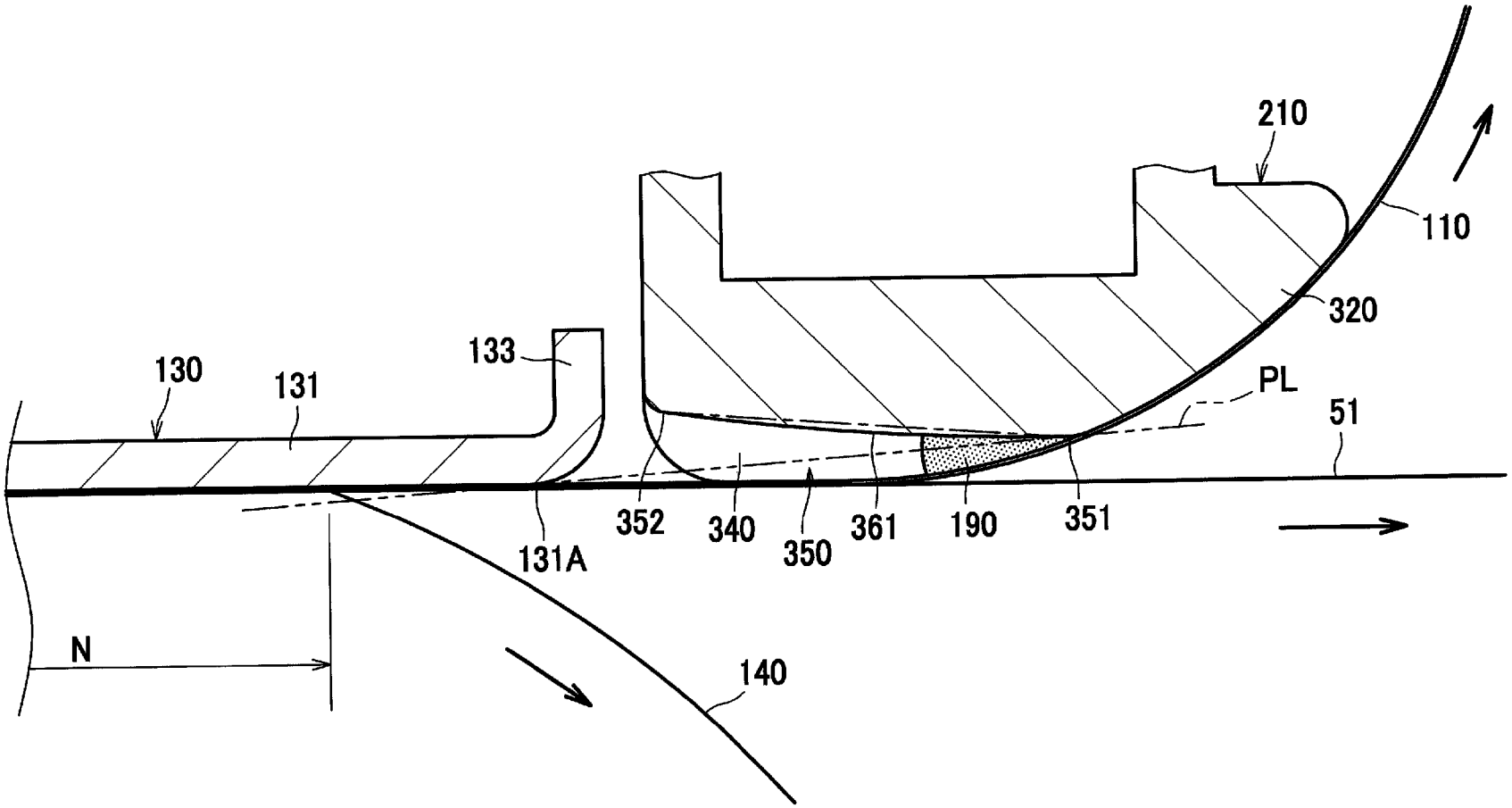
FIG. 6 is an enlarged cross-sectional view of the periphery of a downstream guide in a fixing device according to a first modification example.
Figure 7:
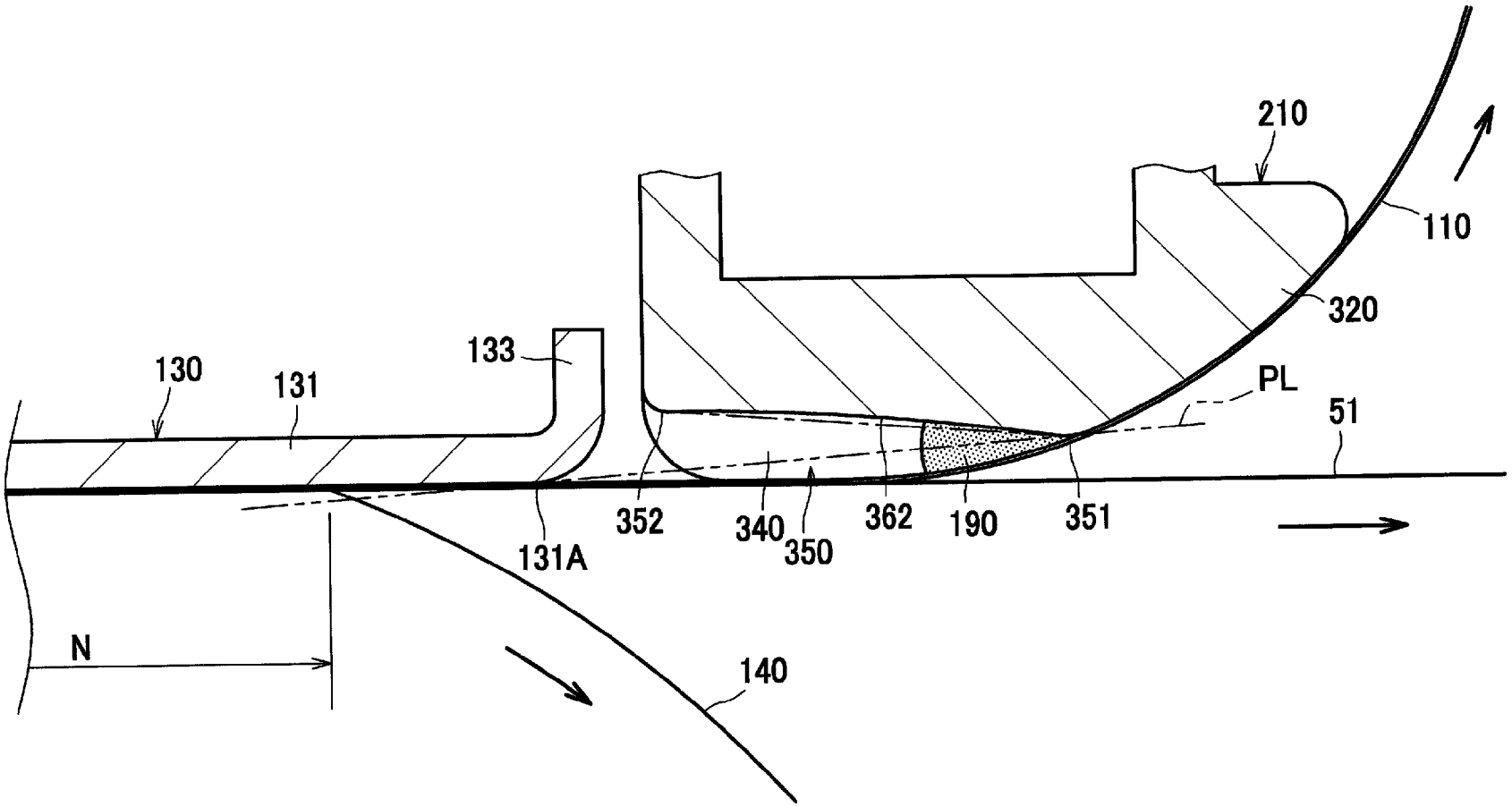
FIG. 7 is an enlarged cross-sectional view of the periphery of a downstream guide in a fixing device according to a second modification example.

In the above-mentioned embodiment, the inclined surface 360 has a planar shape, but the disclosure is not limited to this shape. For example, as illustrated in FIG. 6, the cross-section of an inclined surface 361 as viewed from the width direction of the fixing belt 110 may have a convex curved shape which is convex in the direction approaching the fixing belt 110. Alternatively, as illustrated in FIG. 7, the cross-section of an inclined surface 362 as viewed from the width direction of the fixing belt 110 may have a concave curved shape which is concave in the direction separating from the fixing belt 110.

Figure 8:
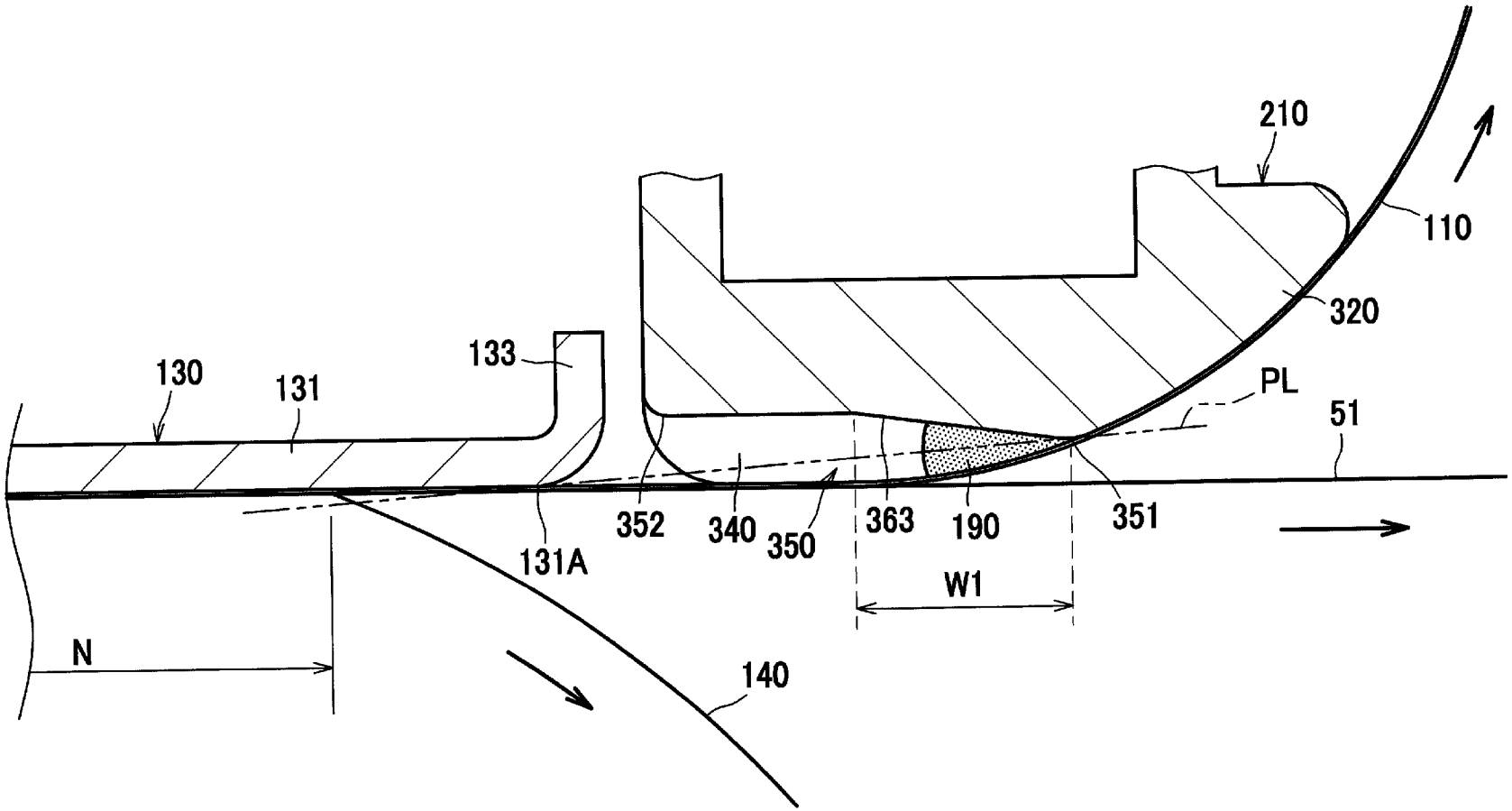
FIG. 8 is an enlarged cross-sectional view of the periphery of a downstream guide in a fixing device according to a third modification example.

In the above-mentioned embodiment, the inclined surface 360 is formed over the entire area of the gap forming portion 350 in the rotational direction of the fixing belt 110, but the disclosure is not limited to this configuration. For example, as illustrated in FIG. 8, an inclined surface 363 may be formed in only a predetermined area W1 from the downstream end 351 of the gap forming portion 350 in the rotational direction of the fixing belt 110 to the upstream side in the rotational direction of the fixing belt 110. Specifically, in the example illustrated in FIG. 8, the inclined surface 363 is formed in a substantially half of a downstream part of the gap forming portion 350 in the rotational direction of the fixing belt 110. In this configuration, the inclined surface 363 may have a planar shape as illustrated in FIG. 8 or may have the same curved shape as illustrated in FIG. 6 or 7.

Figure 9:
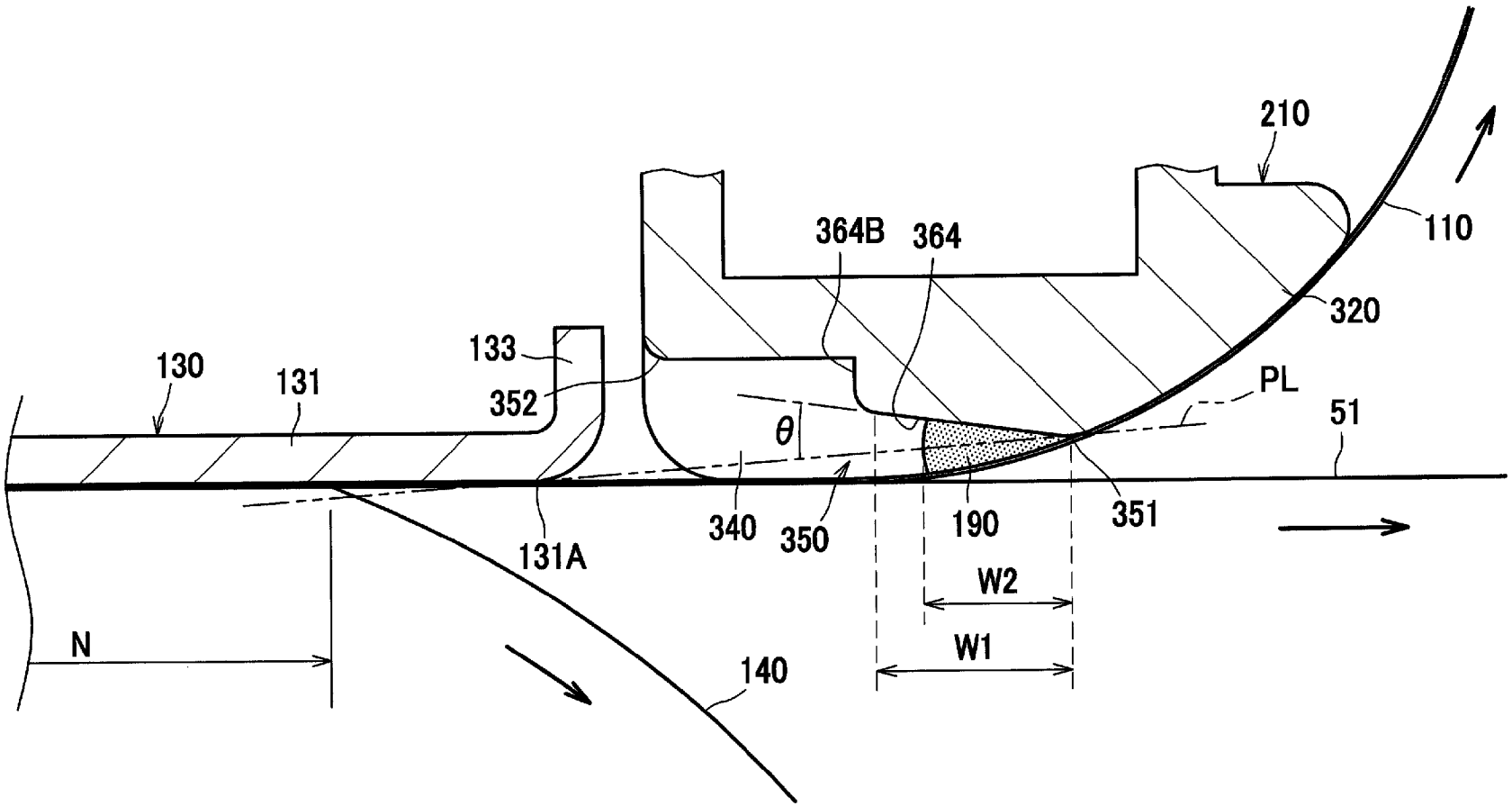
FIG. 9 is an enlarged cross-sectional view of the periphery of a downstream guide in a fixing device according to a fourth modification example.

In the above-mentioned embodiment, the inclined surface 360 is formed such that the maximum inclination angle θ thereof with respect to the plane PL is 90 degrees or less as a whole, but the disclosure is not limited to this configuration. For example, as illustrated in FIG. 9, an inclined surface 364, specifically the bottom surface of the gap forming portion 350, may have a part in which the maximum inclination angle θ with respect to the plane PL is less than 90 degrees in an area W2 on which the grease 190 is collected between the fixing belt 110 and the gap forming portion 350 from the downstream end 351 of the gap forming portion 350, and the maximum inclination angle θ with respect to the plane PL is equal to or greater than 90 degrees in an area upstream from the area W2. Specifically, in the example illustrated in FIG. 9, the bottom surface of the gap forming portion 350 has a part (stepped portion 364B) forming an angle of 90 degrees or more with respect to the plane PL in a part upstream from the area W2 on which the grease 190 is collected and upstream from the predetermined area W1. Since the grease 190 is not collected in the vicinity of the stepped portion 364B in spite of the stepped portion 364B, a problem that the grease 190 is not used for lubrication does not occur.

The area W2 on which the grease 190 is collected becomes often about 2 millimeters from the downstream end 351 of the gap forming portion 350 in the rotational direction of the fixing belt 110. Accordingly, in the inclined surface 364 (the bottom surface of the gap forming portion 350) according to the disclosure, it can be said that the maximum inclination angle θ with respect to the plane PL in the area within 2 millimeters from the downstream end 351 of the gap forming portion 350 is less than 90 degrees. The area W2 on which the grease 190 is collected varies depending on the quantity of the grease 190 disposed on the inner circumferential surface of the fixing belt 110 or the like, and thus the area may be narrower than 2 millimeters.

Figure 10:
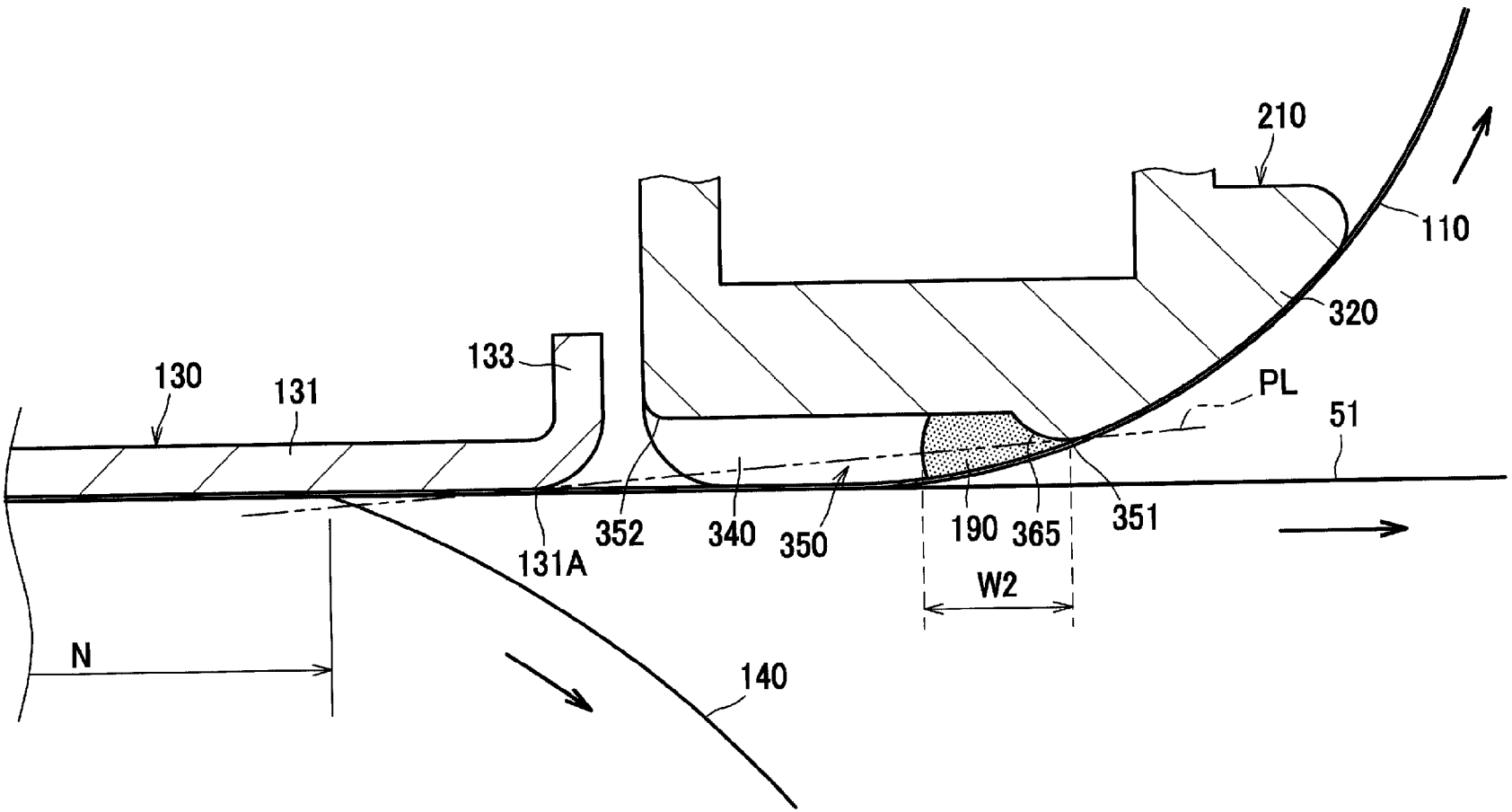
FIG. 10 is an enlarged cross-sectional view of the periphery of a downstream guide in a fixing device according to a fifth modification example.

As illustrated in FIG. 10, an inclined surface 365 may be formed in a downstream part from the area W2 on which the grease 190 is collected. In the example illustrated in FIG. 10, a cross-section of the inclined surface 365 as viewed from the width direction of the fixing belt 110 has a convex curved shape which is convex in the direction approaching the fixing belt 110. More specifically, the cross-section of the inclined surface 365 as viewed from the width direction of the fixing belt 110 has a substantially arc shape.

In the above-mentioned embodiment, the first cover member 210 in which the downstream guide 320 or the gap forming portion 350 as a part of the guide member is disposed downstream from the nip N in the rotational direction of the fixing belt 110 is exemplified as the guide member, but the disclosure is not limited to this example. For example, the whole part of the guide member may be disposed downstream from the nip in the rotational direction of the fixing belt.

In the above-mentioned embodiment, the pressure roller 140 is exemplified as the backup member, but the disclosure is not limited to this configuration and, for example, a pressure member having a belt shape may be used.

In the above-mentioned embodiment, the nip plate 130 is exemplified as an example of the nip member, but the disclosure is not limited to this configuration and a thick member may be used instead of a plate shape.

In the above-mentioned embodiment, the disclosure is applied to the color laser printer 1, but the disclosure is not limited to this configuration. For example, the disclosure may be applied to other image forming apparatuses such as a copying machine and a multifunction machine.

The fixing belt may be formed of a resin film containing polyimide as a main component. In this case, the surface layer of the fixing belt is coated with a fluororesin such as PTFE.

What is claimed is:

1. A fixing device comprising:

an endless belt;

a nip member, which includes a contact portion capable of being in contact with an inner circumferential surface of the endless belt;

a backup member, wherein a nip, where the endless belt is to rotate in a rotational direction, is formed between the endless belt and the backup member with the endless belt being interposed between the nip member and the backup member; and a guide member, wherein the guide member includes:

a guide portion, which is disposed downstream from the nip in the rotational direction of the endless belt and is configured to be in contact with the inner circumferential surface of the endless belt; and a gap forming portion, which is disposed between the nip and the guide portion in the rotational direction of the endless belt and which is separated from the endless belt to form a gap between the endless belt and the gap forming portion, wherein the gap forming portion includes an inclined surface that extends from the guide portion toward upstream in the rotational direction and has a predetermined area, on which a lubricant is provided, wherein a maximum inclination angle between the predetermined area and a plane that is defined to contact a downstream end, in the rotational direction, of the contact portion of the nip member and the guide portion is less than 90 degrees, and wherein a penetration of the lubricant is a range from 100 to 500.

2. The fixing device according to claim 1, wherein the gap forming portion is a depressed portion, and a maximum depth of the gap forming portion is equal to or larger than 0.7 mm.

3. The fixing device according to claim 1, wherein a length of the gap forming portion in the rotational direction is equal to or larger than 0.7 mm and is equal to or less than 5.2 mm.

4. The fixing device according to claim 1, wherein the inclined surface is formed to extend from a downstream end of the gap forming portion to an upstream end of the gap forming portion in the rotational direction.

5. The fixing device according to claim 1, wherein a cross-sectional shape of the inclined surface as viewed from a longitudinal direction of the nip member is an arc shape protruding toward the inner circumferential surface of the endless belt.

6. The fixing device according to claim 1, wherein a cross-sectional shape of the inclined surface as viewed from a longitudinal direction of the nip member is a concave shape separating from the inner circumferential surface of the endless belt.

7. The fixing device according to claim 3, wherein the maximum inclination angle is equal to or less than 30 degrees.

8. The fixing device according to claim 3, wherein the maximum inclination angle is equal to or less than 15 degrees.

9. The fixing device according to claim 1, wherein a conveyance velocity of a sheet at the nip is a range from 200 to 800 mm per second.

10. A fixing device comprising:

an endless belt, which is rotatable;

a nip member, which includes a contact portion capable of being in contact with an inner circumferential surface of the endless belt;

a backup member, wherein a nip is formed between the endless belt and the backup member with the endless belt being interposed between the nip member and the backup member; and a guide member, wherein the guide member includes:

a guide portion, which is disposed downstream from the nip in a rotational direction of the endless belt and is configured to be in contact with the inner circumferential surface of the endless belt, and a gap forming portion, which is disposed between the nip and the guide portion in the rotational direction of the endless belt and which is separated from the endless belt to form a gap from the endless belt, wherein the gap forming portion includes an inclined surface that extends from the guide portion toward upstream in the rotational direction, and on which a lubricant is provided, wherein a maximum inclination angle between an area that is located within 2 millimeters from a downstream end, in the rotational direction, of the gap forming portion and a plane that is defined to contact a downstream end, in the rotational direction, of the contact portion of the nip member and the guide portion is less than 90 degrees, and wherein a penetration of the lubricant is a range from 100 to 500.

11. The fixing device according to claim 10, wherein the gap forming portion is a depressed portion, and a maximum depth of the gap forming portion is equal to or larger than 0.7 mm.

12. The fixing device according to claim 10, wherein a length of the gap forming portion in the rotational direction is equal to or larger than 0.7 mm and is equal to or less than 5.2 mm.

13. The fixing device according to claim 10, wherein the inclined surface is formed to extend from a downstream end of the gap forming portion to an upstream end of the gap forming portion in the rotational direction.

14. The fixing device according to claim 10, wherein a cross-sectional shape of the inclined surface as viewed from a longitudinal direction of the nip member is an arc shape protruding toward the inner circumferential surface of the endless belt.

15. The fixing device according to claim 10, wherein a cross-sectional shape of the inclined surface as viewed from a longitudinal direction of the nip member is a concave shape separating from the inner circumferential surface of the endless belt.

16. The fixing device according to claim 12, wherein the maximum inclination angle is equal to or less than 30 degrees.

17. The fixing device according to claim 12, wherein the maximum inclination angle is equal to or less than 15 degrees.

18. The fixing device according to claim 10, wherein a conveyance velocity of a sheet at the nip is a range from 200 to 800 mm per second.

19. The fixing device according to claim 1, further comprising:

a halogen lamp, which is provided at an inside of the endless belt, wherein the nip member includes a plate-shaped member.

20. The fixing device according to claim 10, further comprising:

a heater, which is provided at an inside of the endless belt, wherein the nip member includes a metal plate and is arranged to receive radiant heat from the heater.

* * * * *